US008839840B2

(12) United States Patent
Bowen et al.

(10) Patent No.: US 8,839,840 B2
(45) Date of Patent: Sep. 23, 2014

(54) ROLLER SHADE ASSEMBLY FOR STIFF SHADE MATERIALS

(75) Inventors: Jesse B. Bowen, Belmont, NC (US); Steven A. Lathrup, Durham, NC (US)

(73) Assignee: Hunter Douglas, Inc., Upper Saddle River, NJ (US)

( * ) Notice: Subject to any disclaimer, the term of this patent is extended or adjusted under 35 U.S.C. 154(b) by 0 days.

(21) Appl. No.: 12/684,669

(22) Filed: Jan. 8, 2010

(65) Prior Publication Data

US 2011/0168339 A1 Jul. 14, 2011

(51) Int. Cl.

| | |
|---|---|
| ***E06B 9/08*** | (2006.01) |
| ***E06B 9/50*** | (2006.01) |
| ***E06B 9/40*** | (2006.01) |
| *E06B 9/78* | (2006.01) |

(52) U.S. Cl.

CPC ..... *E06B 9/50* (2013.01); *E06B 2009/785* (2013.01); *E06B 9/78* (2013.01); *E06B 9/40* (2013.01)

USPC ..... 160/23.1; 160/120; 160/121.1

(58) Field of Classification Search

USPC ..... 160/23.1, 89, 120, 121.1, 122; 242/321, 242/324.1, 238, 264; 248/266, 267, 268

See application file for complete search history.

(56) References Cited

U.S. PATENT DOCUMENTS

| | | | | |
|---|---|---|---|---|
| 611,141 | A * | 9/1898 | Philips | 248/266 |
| 1,810,899 | A * | 6/1931 | Norman | 160/88 |
| 1,943,371 | A * | 1/1934 | Cross | 160/133 |
| 2,808,222 | A * | 10/1957 | Wassyng et al. | 248/262 |
| 4,096,904 | A * | 6/1978 | Donofrio | 160/299 |
| 4,234,973 | A * | 11/1980 | Vetter et al. | 4/500 |
| 4,240,490 | A * | 12/1980 | Ford | 160/133 |
| 4,519,434 | A | 5/1985 | Forquer | |
| 4,834,164 | A * | 5/1989 | Tuhey, Jr. | 160/319 |
| 5,875,829 | A * | 3/1999 | Chou | 160/319 |
| 6,390,428 | B1 * | 5/2002 | Oshima | 248/266 |
| 6,497,267 | B1 * | 12/2002 | Azar et al. | 160/310 |
| 6,860,312 | B2 * | 3/2005 | Judkins | 160/243 |
| 7,100,668 | B2 * | 9/2006 | Allsop | 160/321 |
| 7,353,857 | B2 | 4/2008 | Koop | |
| 7,571,756 | B2 | 8/2009 | Smith et al. | |
| 7,617,858 | B2 | 11/2009 | Hoffmann et al. | |
| 2008/0142171 | A1 | 6/2008 | Koop et al. | |
| 2008/0257505 | A1 * | 10/2008 | Braybrook | 160/321 |

* cited by examiner

*Primary Examiner* — Katherine Mitchell
*Assistant Examiner* — Scott Denion
(74) *Attorney, Agent, or Firm* — Dority & Manning, P.A

(57) ABSTRACT

A roller shade assembly for a shade made from a relatively heavy and/or stiff material is described. The roller shade assembly includes a cylindrical member that is attached to the shade. A control mechanism rotates the cylindrical member for winding the shade upon the cylindrical member. Thus, winding the cylindrical member in one direction causes the shade to retract, while unwinding the cylindrical member in an opposite direction causes the shade to extend. In order to maintain the shade in alignment as the shade is retracted and extended, the roller shade assembly includes a pair of opposing retaining members that may have a disc-like shape. The retaining members may be positioned adjacent to the vertical edges of the shade and have an effective diameter larger than the diameter of the shade when fully wound and retracted. In one embodiment, the roller shade assembly can further include fixed edge guides for further maintaining the shade in alignment.

23 Claims, 8 Drawing Sheets

ROLLER SHADE ASSEMBLY FOR STIFF SHADE MATERIALS

BACKGROUND

Various different types of coverings exist for placement in architectural openings, such as windows, doors, archways and the like. Such coverings include blinds and shades. Many shades, for instance, comprise a fabric covering that is placed in an architectural opening and includes a head rail assembly that not only mounts the shade within the opening, but also provides a control mechanism for raising and lowering the shade as desired. For instance, the control mechanism may comprise a drawstring or an electric motor.

Some shade assemblies include rollers that are rotatably mounted, usually in a horizontal orientation, across the top of the architectural opening. A shade material, such as a fabric, is attached to the roller. Rotating the roller in one direction causes the shade to extend and rotating the roller in an opposite direction causes the shade to retract.

Shade assemblies that include a rotating roller are very popular with consumers. Roller assemblies, for instance, are easy to operate and are very compact, especially when the shade is in a fully retracted position. Roller assemblies, however, have been somewhat limited for use in conjunction with specific types of shade materials. For instance, although roller shade assemblies are well suited for use with lighter and softer materials, such as spunbond materials and lower basis weight woven fabrics, roller assemblies typically do not work well with textured materials or materials that are relatively stiff. Textured materials, for instance, have a tendency to fall out of alignment when being wound on a roller. In particular, the materials have a tendency to skew or telescope at one end which can cause the shade assembly to malfunction and can cause damage to the shade material.

In view of the above, a need currently exists for a roller shade assembly capable of accommodating textured materials.

SUMMARY

In general, the present disclosure is directed to a roller shade assembly that is particularly well suited for use with highly textured shade materials. For instance, in one embodiment, the roller shade assembly is configured for use with "woven woods". Woven woods generally refer to shade materials made from woven natural materials, such as shades made from natural wood, grasses, bamboo, jute, reeds, or mixtures thereof. Such shades are typically produced with an open weave and thus have a segmented look and feel. In the past, such materials have been incorporated into Roman shade systems where the material folds over upon itself and forms pleats when retracted or used in a rollup system where the material rolls up upon itself from the bottom of the shade. Such materials, however, are not well suited for use with conventional roller assemblies that include a top rotating member upon which the material is spirally wound.

In this regard, the present disclosure is directed to an improved roller shade assembly that can accommodate woven woods and other highly textured materials. In one embodiment, the roller shade assembly includes a cylindrical member attached to a first end of a shade. The cylindrical member is rotatably mounted between a first hub and a second hub. Rotation of the cylindrical member in a first direction causes the shade to unwind and extend and rotation of the cylindrical member in an opposite direction causes the shade to wind around the cylindrical member and retract. The shade assembly further includes a control mechanism that is operatively connected to one end of the cylindrical member for rotating the cylindrical member and extending or retracting the shade. The control mechanism, for instance, may comprise a drawstring or an electric motor.

In accordance with the present disclosure, the roller shade assembly further includes first and second retaining members positioned at opposite ends of the cylindrical member and adjacent to the vertical edges of the shade. The retaining members have an effective diameter that is greater than a diameter of the shade and cylindrical member when the shade is in a fully retracted position. In accordance with the present disclosure, the retaining members guide the material as it is wound on the cylindrical member and maintain the shade in alignment for winding the shade onto the cylindrical member in an orderly fashion. The retaining members, for instance, prevent the shade from falling out of alignment or telescoping as the shade is wound upon the cylindrical member.

In one embodiment, the retaining members can have a disk-like shape. The retaining members can also rotate with the cylindrical member as the shade material is wound. In one embodiment, the effective diameter of the retaining members is at least about 5% greater, such as at least about 10% greater than the diameter of the shade and the cylindrical member when in the fully retracted and wound position. For instance, the effective diameter of the retaining members can be at least about 15% greater than the diameter of the shade and the cylindrical member when in the fully wound position.

In one embodiment, the retaining members can include a center area and an outer circumference and can have a shape such that the retaining members flare outwardly away from the vertical edges of the shade along the outer circumference. In this manner, the shade is funneled towards the cylindrical member as it is wound. In other embodiments, however, the cylindrical members may have a more vertical profile.

In one embodiment, in addition to the retaining members, the roller shade assembly may additionally include edge guides. For example, a first edge guide may be positioned adjacent to the first retaining member and a second edge guide may be positioned adjacent to the second retaining member. The first and second edge guides can include a guide portion that extends beyond the effective diameter of the corresponding retaining members in a downward direction. The guide portions may further assist in guiding the shade in between the retaining members and onto the cylindrical member. In one embodiment, the first and second edge guides are stationary and do not rotate with the retaining members and the cylindrical member. The edge guides can have any suitable shape configured to assist in retracting and extending the shade. In one embodiment, for instance, the edge guides may have a semicircular shape that includes an outer circumference that extends beyond a corresponding retaining member. The guide portion of the edge guides can have a substantially straight shape or can be slightly slanted or inclined towards the edges of the shade.

As described above, the roller shade assembly can include a first hub located at the first end of the cylindrical member and a second hub located at the second end of the cylindrical member. In one embodiment, each hub can include a rotatable member and a stationary member. The rotatable member can be journaled with respect to the stationary member to allow the rotatable member to rotate when the stationary member is fixed in position. Each stationary member can be configured to be attached to a bracket for mounting the roller shade assembly into an architectural opening.

In one embodiment, the first and second retaining members can each be attached to the rotatable member of each hub causing the retaining members to rotate with the cylindrical member. The first and second edge guides, on the other hand, may be connected to the stationary members for remaining fixed in place when the shade is retracted or extended.

As described above, the roller shade assembly can include a control mechanism that causes the cylindrical member to rotate clockwise and counterclockwise. In one embodiment, the control mechanism may comprise a sprocket wheel operatively coupled to the cylindrical member for rotating the cylindrical member. A fixed housing can at least partially enclose the sprocket wheel. An endless cord can be looped over the sprocket wheel and held in position along the architectural opening by a tensioning device. The cord can then be used by a user for raising and lowering the shade. In one embodiment, a clutch device, such as a two-way clutch device, may be positioned in between the sprocket wheel and the end of the cylindrical member.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
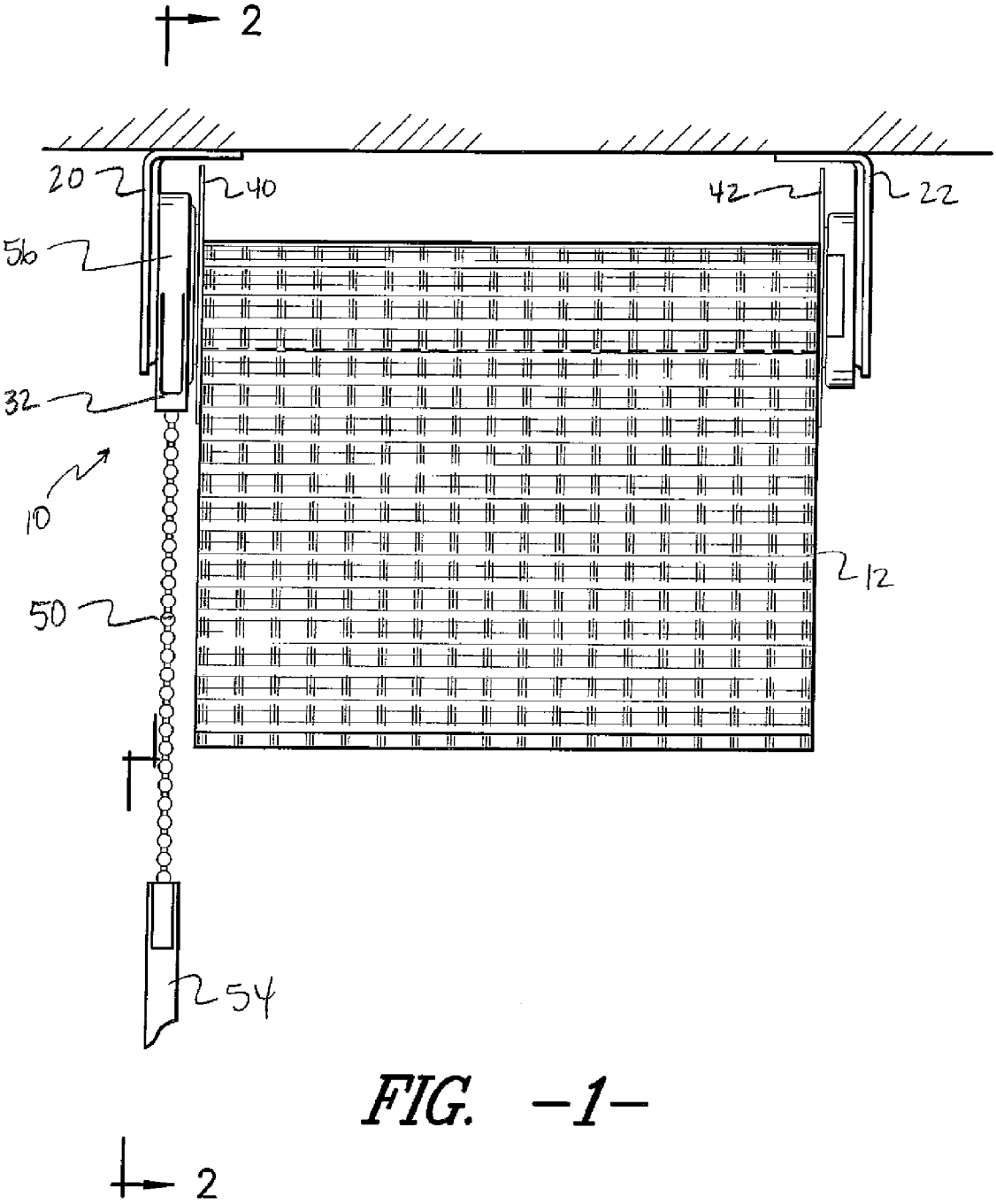
FIG. 1 is a plan view of one embodiment of a roller shade assembly made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to a roller shade assembly that is well suited for use with a shade made from a textured material. The textured material may be relatively heavy and/or stiff. The roller shade assembly of the present disclosure, for instance, is particularly well suited for use with shades made from woven woods. The roller shade assembly includes a cylindrical member that can be mounted adjacent the top of an architectural opening. The shade material can be attached to the cylindrical member and can be extended or retracted within the architectural opening by rotating the cylindrical member. In accordance with the present disclosure, the roller shade assembly includes one or more retaining members and/or one or more edge guides for maintaining the shade material in alignment as it is extended or retracted.

Referring to FIGS. 1 through 4, for instance, one embodiment of a roller shade assembly 10 made in accordance with the present disclosure is shown. As illustrated, the roller shade assembly 10 includes a shade 12 made from a textured material that is attached to a cylindrical member 14 (see FIG. 3). More particularly, an end of the shade 12 is attached or connected to the cylindrical member 14. The end of the shade, for instance, can be adhered to the cylindrical member using an adhesive or can be mechanically affixed to the cylindrical member by being, for instance, inserted into a slot. The cylindrical member 14 is rotatably mounted within the roller shade assembly. Thus, rotating the cylindrical member 14 in one direction causes the shade 12 to extend and rotating the cylindrical member 14 in an opposite direction causes the shade 12 to wind around the cylindrical member and retract.

Figure 3:
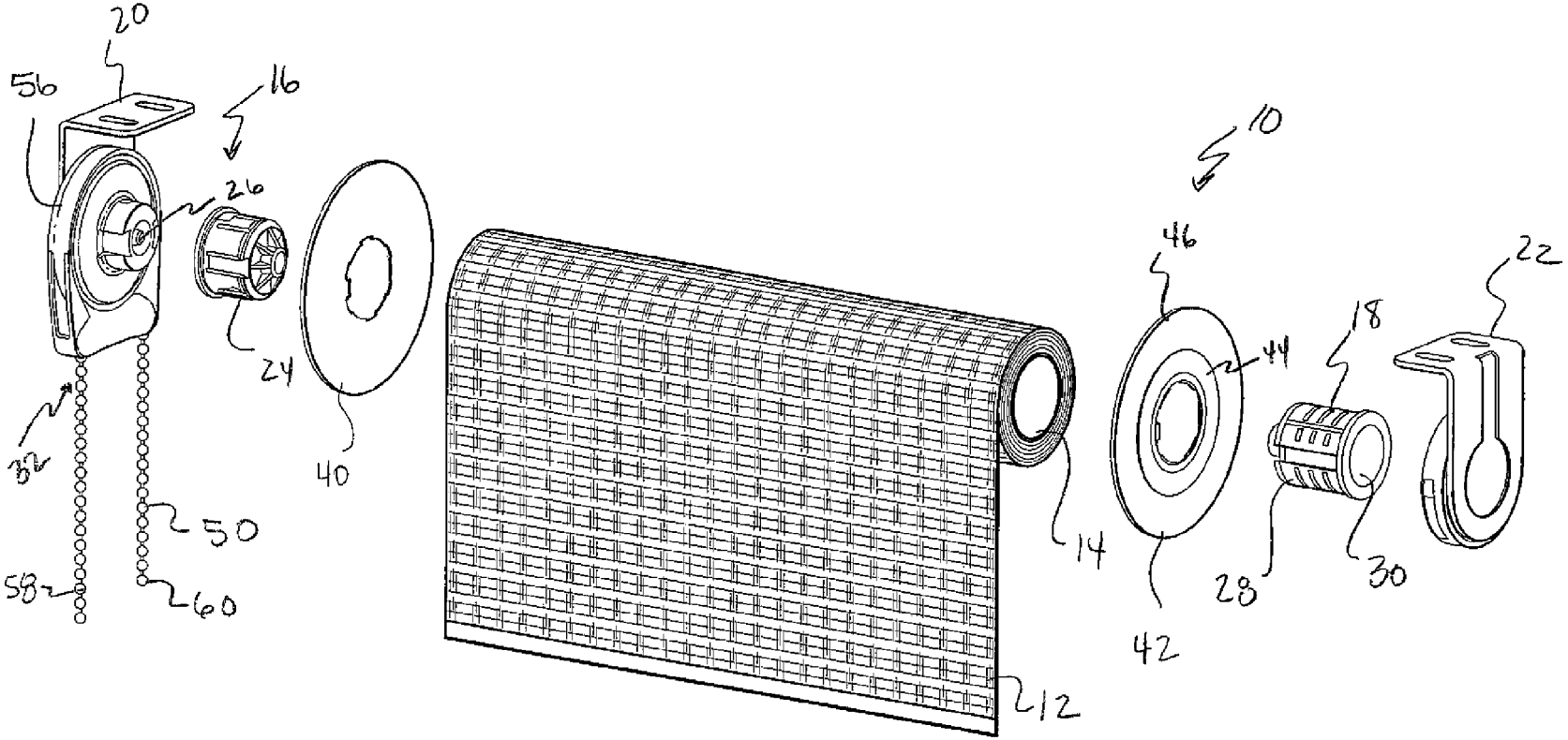
FIG. 3 is an exploded view of the roller shade assembly illustrated in FIG. 1.
Figure 4:
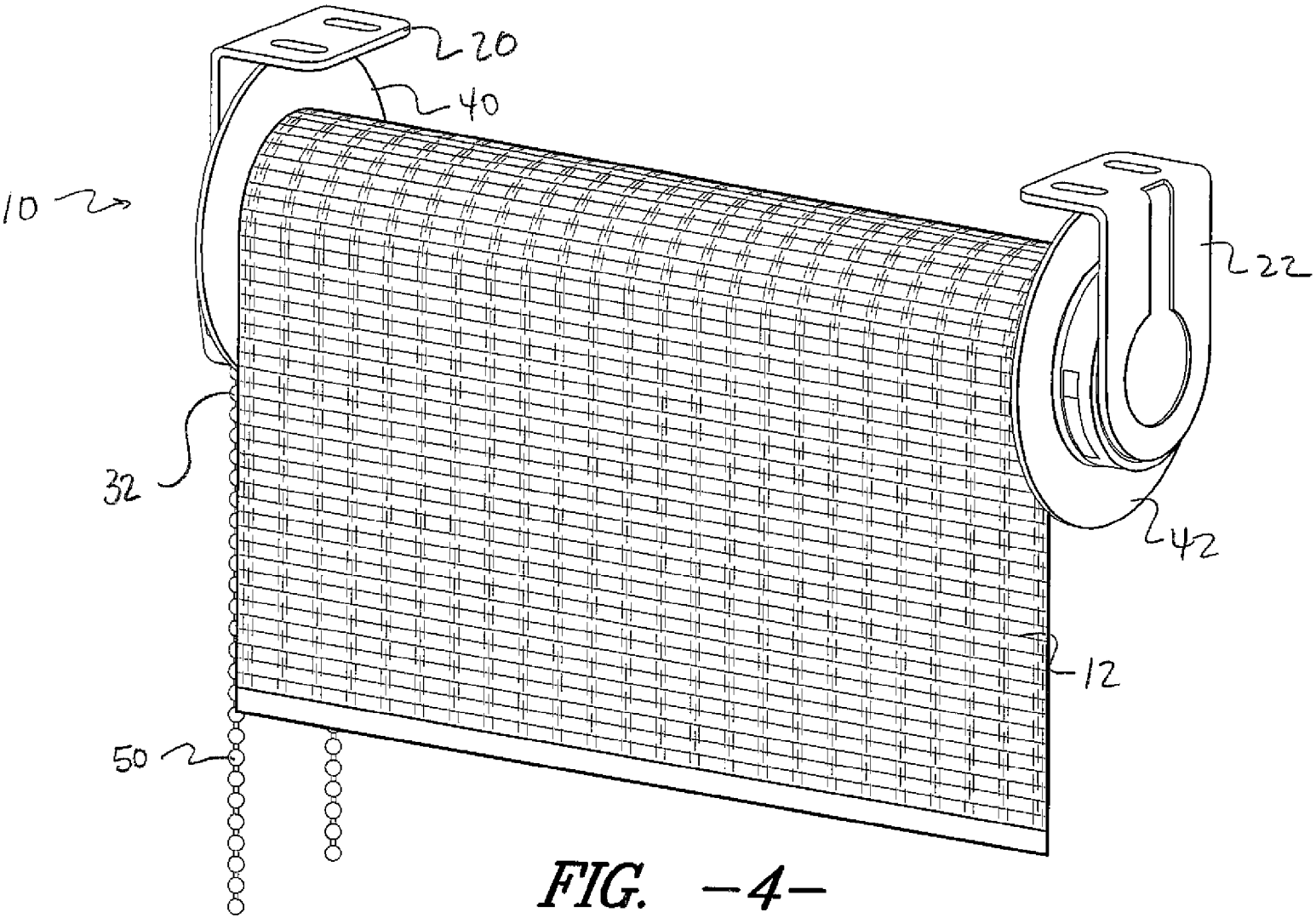
FIG. 4 is a perspective view of the roller shade assembly illustrated in FIG. 1.

As shown in FIG. 3, the cylindrical member 14 is attached at one end to a first hub 16 and at a second end to a second hub 18. The first hub 16 can be attached to a first bracket 20, while the second hub 18 can be attached to a second bracket 22 for mounting the roller shade assembly within an architectural opening, such as a window. In the embodiment illustrated in FIG. 1, the brackets 20 and 22 are designed to be mounted above the roller shade assembly. In alternative embodiments, however, the brackets may be configured to attach to the sides of the architectural opening as opposed to the top of the opening.

The first hub 16 and the second hub 18 are configured to be attached to the brackets 20 and 22 while still allowing the cylindrical member 14 to rotate. For example, in one embodiment, each hub can include a stationary member for attachment to a corresponding bracket and a rotating member that engages an end of the cylindrical member. For instance, the first hub 16 includes a rotatable member 24 that is inserted into one end of the cylindrical member 14 and a stationary member 26 that can attach to the bracket 20. Similarly, the second hub 18 can include a rotatable member 28 that is inserted into the opposite end of the cylindrical member 14 and a stationary member 30 for attachment to the bracket 22. As shown in FIG. 3, the rotatable member 28 of the second hub 18 is journaled for rotation around the stationary member 30. It should be understood, however, that any suitable hub arrangement may be incorporated into the roller shade assembly of the present disclosure.

The roller shade assembly 10 as shown in FIGS. 1 through 4 can further include a control mechanism 32. The control mechanism 32 can be operatively connected to at least one end of the cylindrical member 14. The control mechanism 32 is for rotating the cylindrical member and causing the shade 12 to extend or retract.

In accordance with the present disclosure, the roller shade assembly 10 further includes a first retaining member 40 positioned adjacent to one of the vertical edges of the shade 12 and a second retaining member 42 positioned adjacent to an opposite vertical edge of the shade 12. The first and second retaining members 40 and 42 can be designed to rotate with the cylindrical member 14. For instance, as shown in FIG. 3, the retaining members 40 and 42 can be attached to the rotating members 24 and 28 of the hubs 16 and 18. Alternatively, the retaining members 40 and 42 may be attached directly to the cylindrical member 14 or may be integral with the cylindrical member. The first and second retaining members 40 and 42 force the shade 12 towards the center of the assembly so that the shade winds on the cylindrical member 14 in a straight and controlled manner. The retaining members maintain the edges of the shade 12 in alignment and prevent the material from becoming skewed when the shade is retracted.

As described above, the roller shade assembly 10 as shown in the figures is particularly well suited for use with shades made from highly textured materials. In fact, the retaining members 40 and 42 may not work well in conjunction with conventional roller shade materials made from light and/or softer materials. The less textured and light or softer materials, for instance, may have a tendency to fold over or crease onto itself if retaining members as shown in FIG. 1 were present.

In the embodiment illustrated in FIGS. 1 through 4, the retaining members 40 and 42 generally have a disk-like shape. For example, the retaining members can be circular in shape. It should be understood, however, that the retaining members can have any suitable shape that is capable of guiding the shade 12 as it is wound on the cylindrical member 14. For instance, the retaining members 40 and 42 may be in the shape of a polygon or may have an abstract shape that, in certain applications, may have aesthetic appeal. The retaining members 40 and 42, however, should have a size such that at least portions of the walls of the retaining members are larger than the cylindrical member and shade 12 when the shade is fully wound on the cylindrical member. For instance, the retaining members 40 and 42 can have an effective diameter that is greater than the diameter of the shade and cylindrical member when the shade is fully wound. The effective diameter of the retaining members refers to the diameter of the retaining members drawn around the outermost perimeter or circumference of the retaining member from the center of the cylindrical member.

For example, in one embodiment, the effective diameter of the retaining members 40 and 42 can be at least about 5% greater, such as at least about 10% greater than the diameter of the shade and cylindrical member when the shade is in the fully wound position. In one embodiment, for instance, the effective diameter of the retaining members can be at least about 15% greater than the diameter of the shade and cylindrical member when fully wound. The effective diameter of the retaining members should also be not so great so as to interfere with the ability of the roller shade assembly to be mounted within an architectural opening. The maximum effective diameter of the retaining members may depend upon various factors and circumstances. In one embodiment, for instance, the effective diameter can be less than about 40% of the diameter of the shade and cylindrical member when the shade is fully wound.

Figure 7:
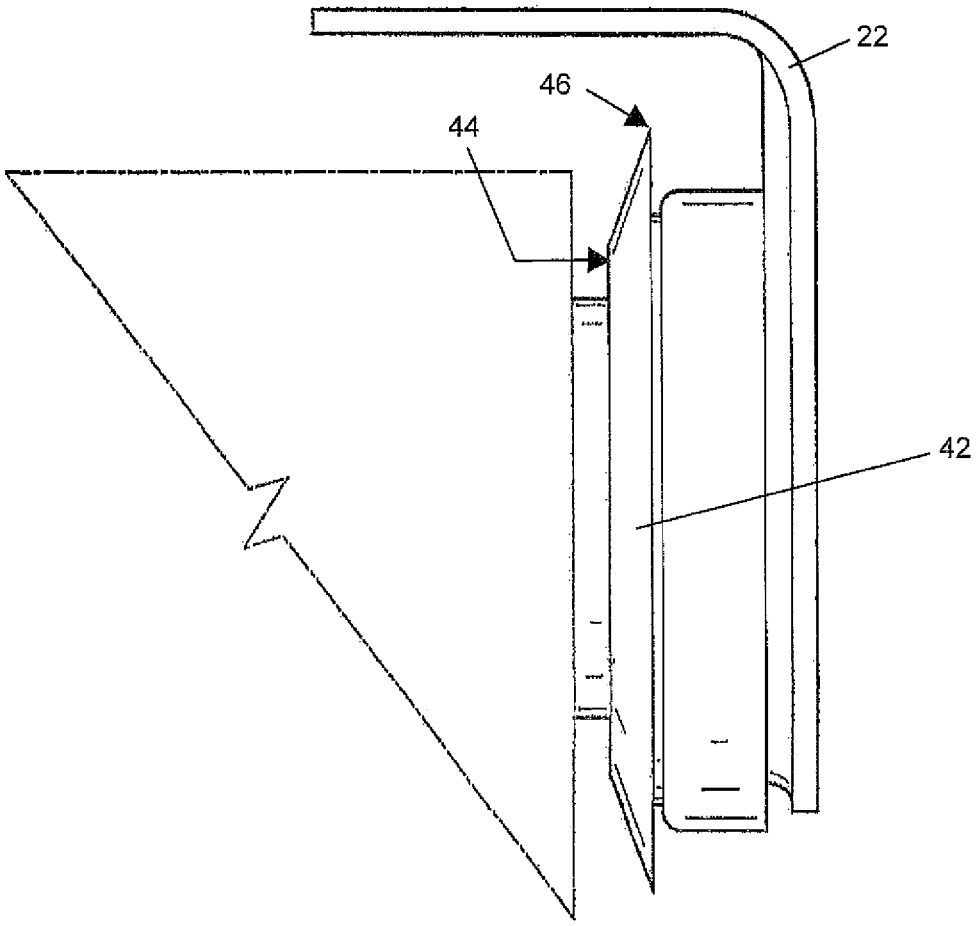
FIG. 7 is a partial side view of another embodiment of a roller shade assembly in accordance with the present disclosure.

The retaining members 40 and 42 can have a side profile that is substantially linear as shown in the embodiment illustrated in FIG. 1. In an alternative embodiment, however, as shown in FIG. 3, the retaining member 42 may include a center area 44 and an outer circumference 46. In one embodiment, the retaining member may flare outwardly along the outer circumference 46 away from the vertical edges of the shade 12 (FIG. 7). Having the outer circumference flare outwardly may assist in funneling the shade 12 as it is wound on the cylindrical member.

As described above, the roller shade assembly 10 of the present disclosure is particularly well suited for use with shades made from textured materials. In FIGS. 1 through 4, for instance, the shade 12 comprises a woven wood material. The woven wood material, for instance, can be made from natural wood, grasses, bamboo, jute, reeds, or mixtures thereof. Woven woods are generally highly textured and tend to be relatively stiff across the width of the shade. The stiffness and texture of the material typically causes skewing to occur on conventional roller shade assemblies. The retaining members, however, have been found to maintain the material in alignment as it is wound upon the cylindrical member.

In addition to woven woods, it should be understood, however, that the shade 12 can be made from any textured, relatively stiff and/or heavy material. Textured materials, for instance, generally refer to materials having a non-uniform thickness. The shade material, for instance, may have a thickness that varies by at least about 2%, such as at least about 5%, such as at least about 7%, such as at least about 10%, over the surface area of the material.

Figure 2:
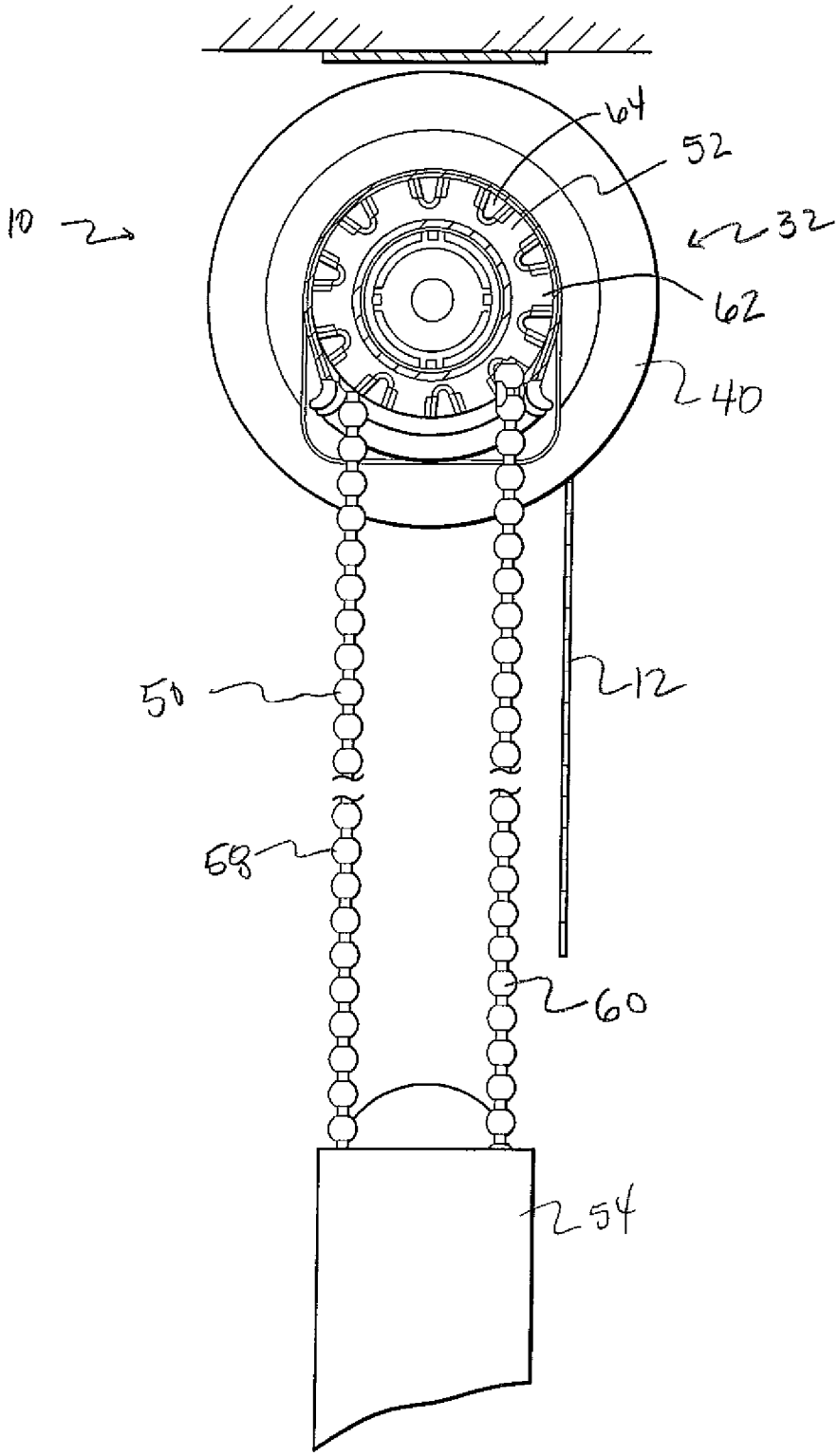
FIG. 2 is a cross-sectional view of the roller shade assembly illustrated in FIG. 1.

As shown particularly in FIGS. 1-3, the roller shade assembly 10 includes the control mechanism 32 for raising and lowering the shade 12. In general, any suitable control mechanism can be used in conjunction with the present disclosure. In the embodiment illustrated, for instance, a manual control mechanism is illustrated that includes a cord 50. In other embodiments, however, the control mechanism 32 may comprise an electric motor or any other suitable device capable of rotating the cylindrical member 14.

The manual control mechanism 32 shown in the drawings is more particularly illustrated in FIG. 2. As shown, the cord 50 comprises a ball chain in the shape of an endless loop. The cord 50 at one end engages a sprocket wheel 52 and engages at the opposite end a tensioning device 54. The tensioning device is configured to be mounted within the architectural opening for providing tension to the cord 50.

As shown in FIGS. 1 and 3, the sprocket wheel 52 is at least partially covered by a stationary housing 56. The cord 50 is looped over and operatively connected to the sprocket wheel 52, which is in turn operatively connected to the cylindrical member 14 via a clutch device. As shown in FIG. 2, the cord 50 includes a first chain portion 58 and a second chain portion 60 that extend from the sprocket wheel 52. By pulling on one of the chain portions 58 and 60, a user can rotate the sprocket wheel 52 to a desired direction for extending or retracting the shade 12.

In one embodiment, the sprocket wheel 52 can include a front plate, a rear plate, and a circumferential outer surface between the front and rear plates. On the outer circumferential surface, the sprocket wheel 52 can include a plurality of radially extending sprocket teeth 62 that form pockets 64. In the embodiment illustrated, the balls of the cord 50 fit within the pockets 64 of the sprocket wheel 52. The housing 56 also helps to maintain the cord suitably engaged with the pockets of the sprocket wheel. In particular, the housing 56 is designed to prevent the cord 50 from disengaging the sprocket wheel 52. In this arrangement, pulling one of the chain portions causes the balls on the cord to engage the sprocket wheel 52 and to rotate the sprocket wheel a desired direction. In one embodiment, a stop mechanism can also be associated with the cord 50 for preventing the sprocket wheel from being over rotated in a certain direction.

Thus, pulling one of the chain portions 58 or 60 causes the cord 50 to engage the sprocket wheel 52 and to rotate the sprocket wheel counter clockwise or clockwise. The cylindrical member rotates with the sprocket wheel for rolling or unrolling the shade 12. Suitable control mechanisms as shown in FIG. 2 that may be incorporated into the roller shade assembly of the present disclosure are disclosed, for instance, in U.S. Pat. No. 7,353,857, U.S. Pat. No. 7,571,756 and in U.S. Patent Application Publication No. 2008/0142171, which are all incorporated herein by reference.

Figure 5:
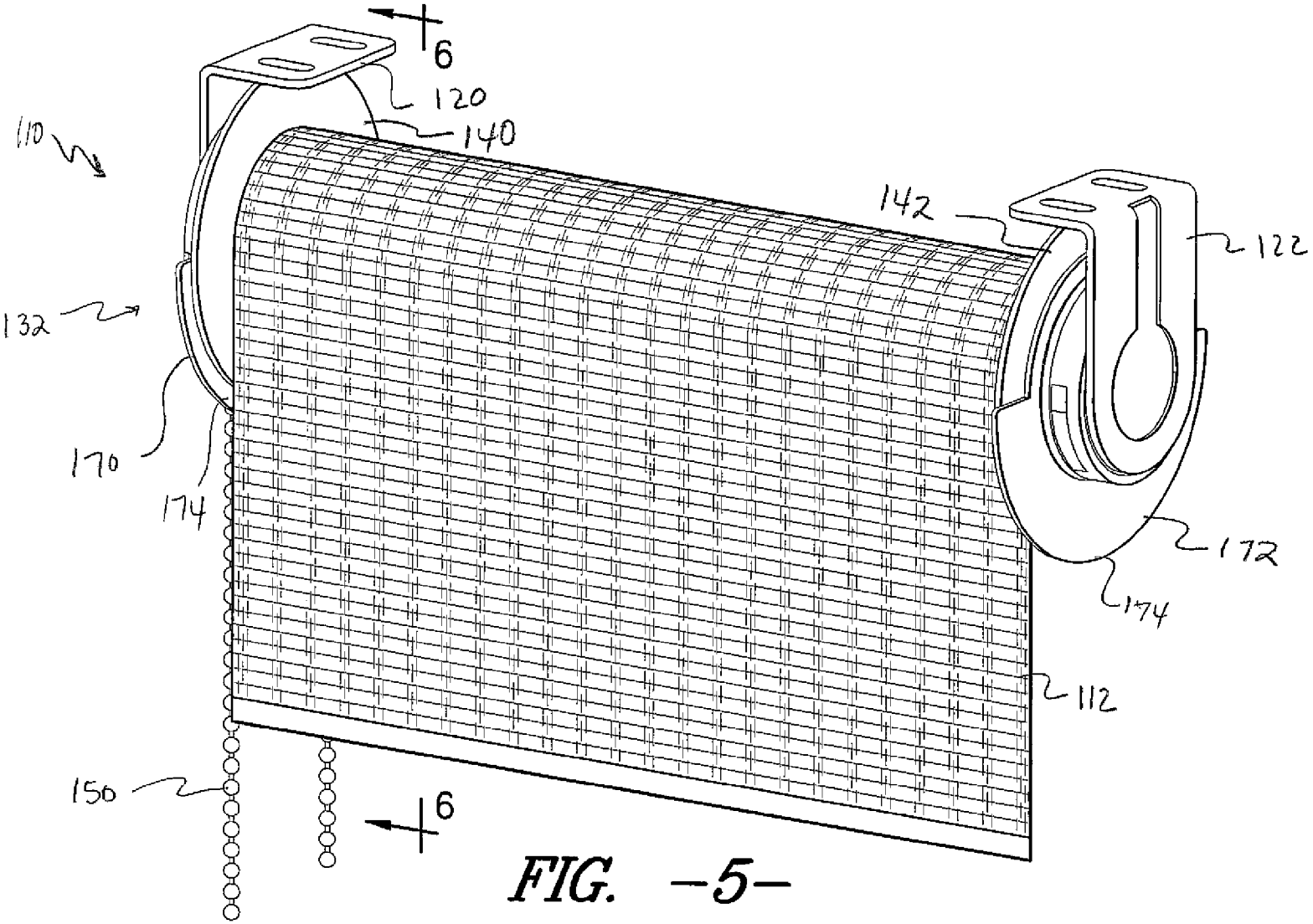
FIG. 5 is a perspective view of another embodiment of a roller shade assembly made in accordance with the present disclosure.
Figure 6:
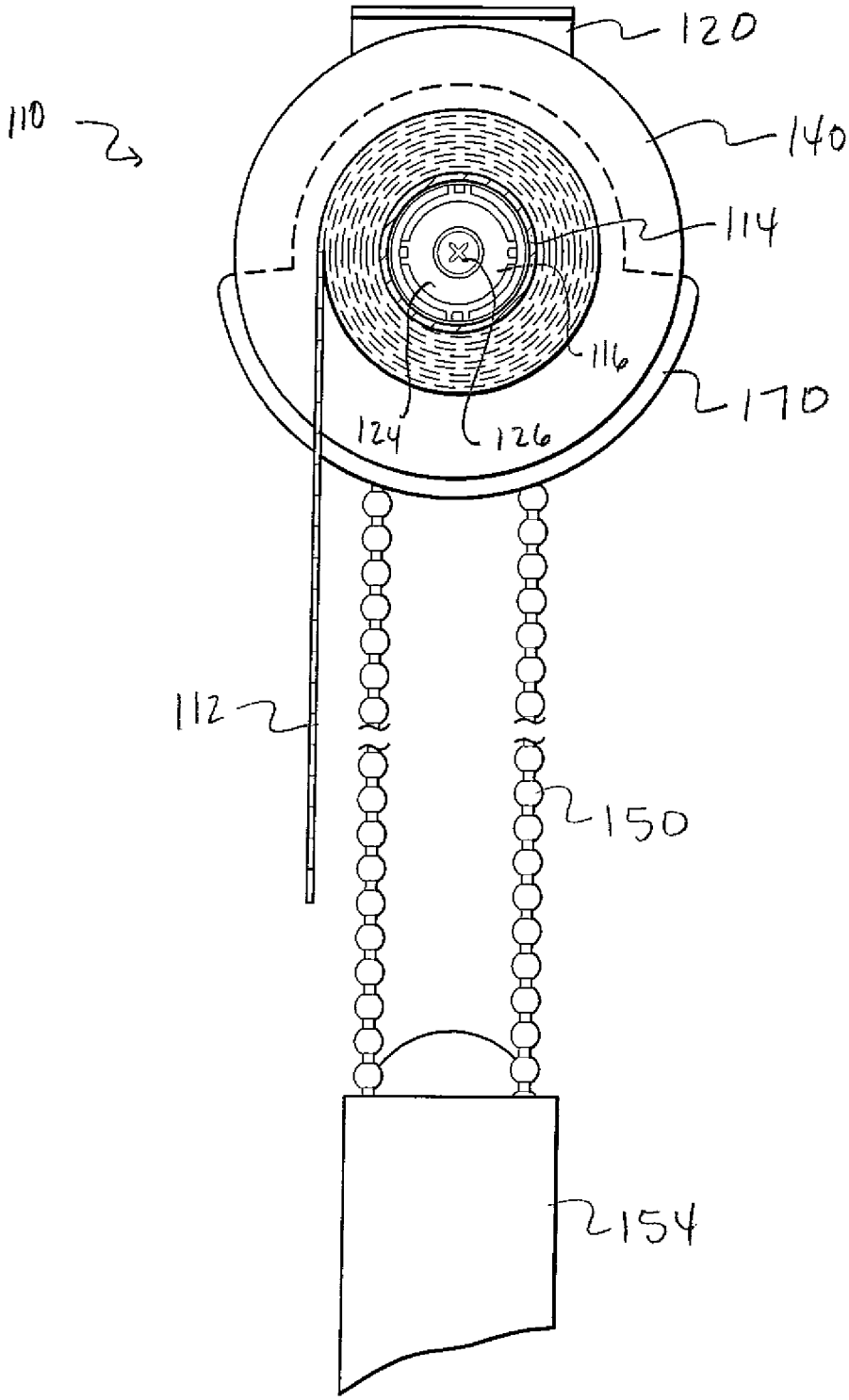
FIG. 6 is a cross-sectional view of the roller shade assembly illustrated in FIG. 5.

Referring now to FIGS. 5 and 6, an alternative embodiment of a roller shade assembly generally 110 made in accordance with the present disclosure is shown. Similar to the embodiment in FIGS. 1-4, the roller shade assembly 110 includes a shade 112 wound upon a cylindrical member 114 as particularly shown in FIG. 6. The cylindrical member 114 is attached at one end to a first hub 116 and at an opposite end to a second hub that are each, in turn, attached to brackets 120 and 122 respectively for mounting the roller shade assembly in an architectural opening, such as a window. The roller shade assembly 110 further includes a control mechanism 132 that, in this embodiment, includes a cord or chain 150 that can be used to rotate the cylindrical member 114 and lower or raise the shade 112. As shown in FIG. 6, in one embodiment, the cord 150 can be in the shape of an endless loop that can be tensioned adjacent to an architectural opening by a tensioning device 154.

In accordance with the present disclosure, the roller shade assembly 110 further includes a first retaining member 140 positioned adjacent to one vertical edge of the shade 112 and a second retaining member 142 positioned adjacent to the opposite vertical edge of the shade 112. As described above, the retaining members 140 and 142 can rotate with the cylindrical member 114 and assist in maintaining the shade 112 in alignment as the shade is raised and wound onto the cylindrical member.

In the embodiment illustrated in FIGS. 5 and 6, the roller shade assembly further includes a pair of edge guides 170 and 172. For instance, the assembly includes a first edge guide 170 positioned adjacent to the first retaining member 140 and includes a second edge guide 172 that is positioned adjacent to the second remaining member 142. The edge guides 170 and 172 each include a guide portion 174 that extends beyond the effective diameter of a corresponding retaining member in a downward direction. The guide portions 174 further assist in guiding the shade 112 in between the retaining members 140 and 142.

In one embodiment, for instance, the edge guides 170 and 172 can be stationary and not rotate with the cylindrical member 114 or the retaining members 140 and 142. The fixed edge guides, and particularly the guide portions 174 preposition the shade 112 and feed the vertical edges of the shade in between the retaining members 140 and 142.

The edge guides 170 and 172 and the guide portions 174 can have any suitable shape capable of directing the shade 112 into the appropriate position. In one embodiment, as shown in FIGS. 5 and 6, the edge guides 170 and 172 have a semi-circular shape. For instance, in one embodiment, the edge guides 170 and 172 can be hemi-circular. As shown in FIGS. 5 and 6, the edge guides 170 and 172 have a maximum diameter in a generally downward direction such that the edge guides extend beyond the effective diameter of the retaining members 140 and 142 adjacent to the vertical edges of the shade 112.

Figure 8:
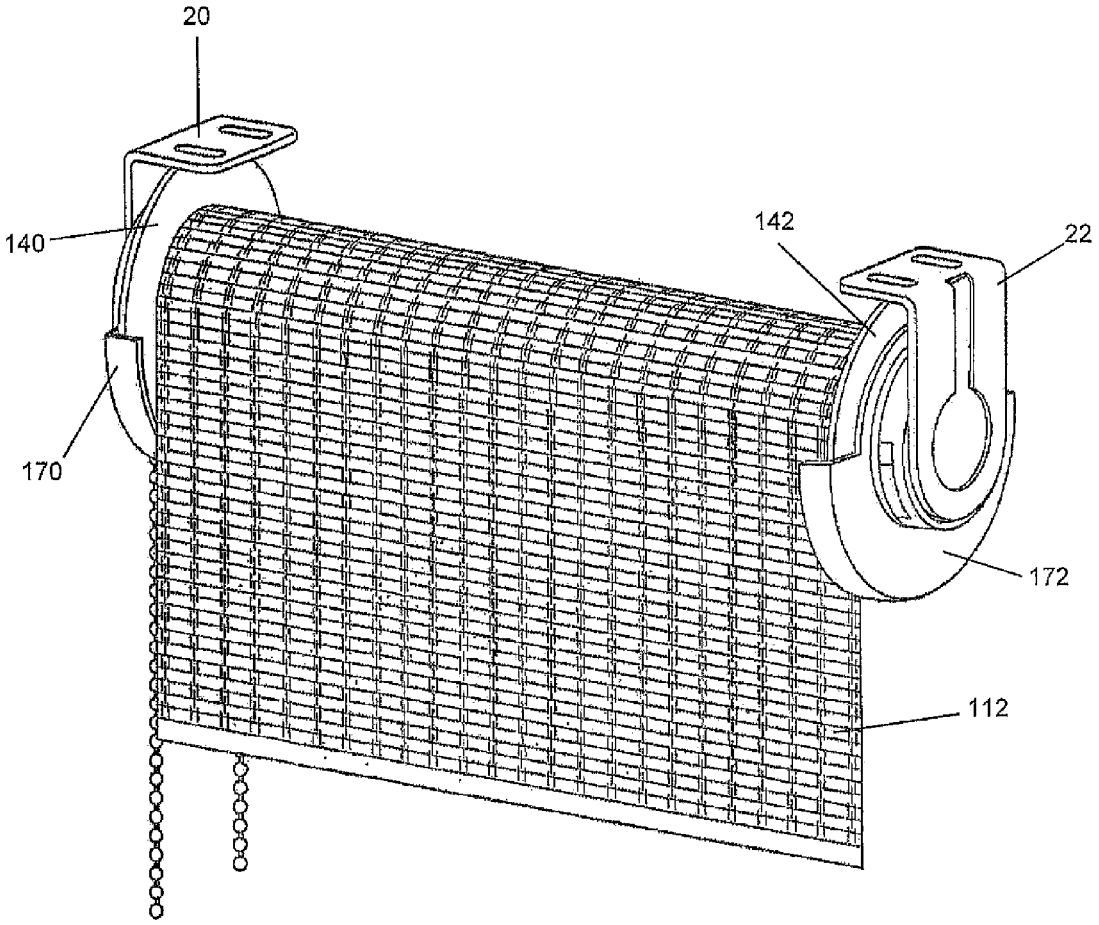
FIG. 8 is a perspective view of another embodiment of a roller shade assembly made in accordance with the present disclosure.

The guide portions 174 of the edge guides 170 and 172 can be straight or angled with respect to the vertical edges of the shade 112 depending upon the particular application. In one embodiment, for instance, the guide portions 174 may be substantially vertical and therefore parallel to the vertical edges of the shade 112. In an alternative embodiment, however, the guide portions 174 may slant inwardly towards the vertical edges of the shade 112. In still another embodiment, the guide portions 174 may slant outwardly with respect to the vertical edges of the shade 112 in order to funnel the edges in between the first retaining member 140 and the second retaining member 142 (FIG. 8).

As described above, in one embodiment, the retaining members 140 and 142 rotate with the cylindrical member 114, while the edge guides 170 and 172 remain stationary. In one embodiment, for instance, as shown in FIG. 6, the roller shade assembly 110 can include a first hub 116 that includes a rotatable member 124 and a stationary member 126. The retaining member 140 can be attached to the rotatable member 124, while the edge guide 170 can be attached to the stationary member 126.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A roller shade assembly comprising:

a shade having a first end and a second and opposite end, the shade further including a first vertical edge opposite a second vertical edge and defining a plane between the first and second vertical edges when in an extended position;

a cylindrical member attached to the first end of the shade, the cylindrical member being rotatably mounted between a first hub and a second hub, wherein rotating the cylindrical member in a first direction causes the shade to extend and wherein rotating the cylindrical member in an opposite direction causes the shade to wind around the cylindrical member and retract;

a control mechanism operatively connected to at least one end of the cylindrical member for rotating the cylindrical member and extending or retracting the shade;

first and second retaining members positioned at opposite ends of the cylindrical member and adjacent to respective vertical edges of the shade, the retaining members having an effective diameter that is greater than a diameter of the shade and cylindrical member when the shade is in a fully retracted position; and a first edge guide positioned adjacent to the first retaining member and a second edge guide positioned adjacent to the second retaining member, the first and second edge guides including a guide portion that extends beyond the effective diameter of the corresponding retaining member in a downward direction and beyond the effective diameter of the corresponding retaining member in a direction substantially perpendicular to the plane defined by the shade in the extended position, each guide portion being positioned to direct the vertical edges of the shade between the first and second retaining members when the shade is being retracted.

2. A roller shade assembly as defined in claim 1, wherein the retaining members rotate with the cylindrical member.

3. A roller shade assembly as defined in claim 1, wherein the retaining members have a disk shape.

4. A roller shade assembly as defined in claim 1, wherein the control mechanism comprises a sprocket wheel operatively coupled to the cylindrical member for rotating the cylindrical member, the control mechanism further including a fixed housing at least partially enclosing the sprocket wheel and an endless cord looped over the sprocket wheel.

5. A roller shade assembly as defined in claim 1, wherein the retaining members include a center area and an outer circumference and wherein the retaining members flare outwardly at least along the outer circumference away from the vertical edges of the shade.

6. A roller shade assembly as defined in claim 1, wherein the shade comprises a woven material containing natural wood, grasses, bamboo, jute, reeds, or mixtures thereof.

7. A roller shade assembly as defined in claim 1, wherein the effective diameter of the retaining members is at least 5% greater than the diameter of the shade and cylindrical member when the shade is in the fully retracted position.

8. A roller shade assembly as defined in claim 1, wherein the first and second edge guides are stationary and do not rotate with the cylindrical member.

9. A roller shade assembly as defined in claim 2, wherein the first and second edge guides are stationary and do not rotate with the cylindrical member.

10. A roller shade assembly as defined in claim 1, wherein the first and second edge guides have a semicircular shape.

11. A roller shade assembly as defined in claim 9, wherein the retaining members have a disk shape and wherein the edge guides have a semicircular shape.

12. A roller shade assembly as defined in claim 1, wherein the guide portions of the edge guides slant inwardly towards the vertical edges of the shade.

13. A roller shade assembly as defined in claim 1, wherein each hub includes a rotatable member and a stationary member, the rotatable member being journaled with respect to the stationary member, the rotatable member being connected to a respective end of the cylindrical member.

14. A roller shade assembly as defined in claim 1, wherein the shade is comprised of a textured material that has a thickness that varies by at least 2% over the surface area of the material.

15. A roller shade assembly as defined in claim 1, wherein the effective diameter of the retaining members is at least 10% greater than the diameter of the shade and cylindrical member when the shade is in the fully retracted position.

16. A roller shade assembly as defined in claim 13, wherein the first retaining member is attached to the rotatable member of the first hub and the second retaining member is attached to the rotatable member of the second hub.

17. A roller shade assembly as defined in claim 16, wherein the first edge guide is attached to the stationary member of the first hub and the second edge guide is attached to the stationary member of the second hub.

18. A roller shade assembly as defined in claim 4, wherein the endless cord comprises a chain.

19. A roller shade assembly comprising:

a shade having a first end and a second and opposite end, the shade further including a first vertical edge opposite a second vertical edge and defining a plane between the first and second vertical edges when in an extended position, the shade comprising a woven wood;

a cylindrical member attached to the first end of the shade, the cylindrical member being rotatably mounted between a first hub and a second hub, wherein rotating the cylindrical member in a first direction causes the shade to extend and wherein rotating the cylindrical member in an opposite direction causes the shade to wind around the cylindrical member and retract;

a control mechanism operatively connected to at least one end of the cylindrical member for rotating the cylindrical member and extending or retracting the shade;

a first retaining member attached to one end of the cylindrical member and a second retaining member attached to an opposite end of the cylindrical member, each retaining member being positioned adjacent to respective vertical edges of the shade, the retaining members having an effective diameter that is greater than a diameter of the shade and cylindrical member when the shade is in a fully retracted position, the effective diameter of the retaining members being from about 5% to about 40% greater than the diameter of the shade and cylindrical member when the shade is in a fully retracted and wound position; and a first edge guide positioned adjacent to the first retaining member and a second edge guide positioned adjacent to the second retaining member, the first and second edge guides including a guide portion that extends beyond the effective diameter of the corresponding retaining member in a downward direction and beyond the effective diameter of the corresponding retaining member in a direction substantially perpendicular to the plane defined by the shade in the extended position, each guide portion being positioned to direct the vertical edges of the shade between the first and second retaining members when the shade is being retracted.

20. A roller shade assembly as defined in claim 19, wherein the retaining members rotate with the cylindrical member.

21. A roller shade assembly as defined in claim 19, wherein the first and second edge guides are stationary and do not rotate with the cylindrical member.

22. A roller shade assembly as defined in claim 19, wherein the shade is comprised of a textured material that has a thickness that varies by at least 2% over the surface area of the material.

23. A roller shade assembly as defined in claim 19, wherein the effective diameter of the retaining members is at least 10% greater than the diameter of the shade and cylindrical member when the shade is in the fully retracted position.

* * * * *